US006863467B2

(12) United States Patent
Buehler et al.

(10) Patent No.: US 6,863,467 B2
(45) Date of Patent: Mar. 8, 2005

(54) CRASH CUSHION WITH DEFLECTOR SKIN

(75) Inventors: Michael J. Buehler, Roseville, CA (US); James B. Welch, Placerville, CA (US)

(73) Assignee: Energy Absorption Systems, Inc., Chicago, IL (US)

( * ) Notice: Subject to any disclaimer, the term of this patent is extended or adjusted under 35 U.S.C. 154(b) by 1 day.

(21) Appl. No.: 10/084,607

(22) Filed: Feb. 27, 2002

(65) Prior Publication Data

US 2003/0161682 A1 Aug. 28, 2003

(51) Int. Cl.[7] ..... E01F 15/14
(52) U.S. Cl. ..... 404/6; 404/10
(58) Field of Search ..... 404/6, 10; 256/13.1

(56) References Cited

U.S. PATENT DOCUMENTS 3,845,936 A 11/1974 Boedecker, Jr. et al.
3,856,268 A 12/1974 Fitch
3,880,404 A 4/1975 Fitch
4,452,431 A * 6/1984 Stephens et al. ..... 256/13.1
4,583,716 A 4/1986 Stephens et al.
4,645,375 A 2/1987 Carney, III
5,011,326 A 4/1991 Carney, III
5,125,762 A * 6/1992 Strassil ..... 404/6
5,403,112 A 4/1995 Carney, III
5,607,252 A 3/1997 Tischer
5,733,062 A 3/1998 Oberth et al.
6,082,926 A * 7/2000 Zimmer ..... 404/6
6,116,805 A 9/2000 Gertz
6,126,144 A 10/2000 Hirsch et al.
6,293,727 B1 9/2001 Albritton
6,340,268 B1 1/2002 Alberson et al.
6,427,983 B1 * 8/2002 Leonhardt et al. ..... 256/13.1
6,461,076 B1 * 10/2002 Stephens et al. ..... 404/6
6,554,529 B2 * 4/2003 Stephens et al. ..... 404/6

OTHER PUBLICATIONS

"QuadGuard®, A Proven–Effective Crash Cushion", *Energy Absorption Systems, Inc.*, 2000, pp. 1–37.
"Saving Lives by Design", *Energy Absorption Systems, Inc.*, pp. 1–15, 1998.
"QuadGuard®, Family of Crash Cushions", *Enery Absorption Systems, Inc.*, 8/97.

* cited by examiner

*Primary Examiner*—Gary S. Hartmann
(74) *Attorney, Agent, or Firm*—Brinks Hofer Gilson & Lione

(57) ABSTRACT

A crash cushion comprising a resilient cylinder having a substantially vertical longitudinal axis and an outer surface at least a portion of which is adapted to be exposed in or to a roadway. A deflector skin has a curved contour shaped to mate with the outer surface of the cylinder. The deflector skin is mounted on the outer surface over at least a portion of the portion of the outer surface that is adapted to be exposed to the roadway. A crash cushion system includes an array of cylinders and at least one deflector skin. In another aspect, a plurality of cylinders, at least some of which define a side of the array, each have an outermost vertical tangent, the combination of which defines a vertical plane. One or more deflector skins each including a leading edge and a trailing edge are mounted to corresponding ones of the cylinders forwardly of the tangent. In one preferred embodiment, the one or more deflector skins are substantially flat and are oriented in a non-parallel relationship with the vertical plane. Preferably, only the leading edge of the deflector skins is mounted to the cylinder. Methods for using and assembling the crash cushion systems are also provided.

20 Claims, 6 Drawing Sheets

CRASH CUSHION WITH DEFLECTOR SKIN

BACKGROUND

The present invention relates to a crash cushion, and in particular to a crash cushion having one or more deflector skins adapted to redirect a laterally impacting vehicle, and methods for the use thereof.

Roadways are often configured or lined with protective crash barriers that protect drivers from various rigid objects, such as bridge abutments, guardrails and other obstructions. Likewise, slow moving vehicles, such as trucks, can be outfitted with truck-mounted attenuators to attenuate the impact of vehicle striking them from the rear. In various configurations, highway crash barriers and truck-mounted attenuators can be constructed of an array of compressible, resilient, energy-absorbing cylinders positioned in front of or alongside the rigid object. In operation, and in particular during an axial impact, the cylinders are compressed and absorb the energy of the impacting vehicle, thereby decelerating the vehicle in a controlled manner. However, during a lateral impact, the vehicle may tend to snag or pocket one or more of the cylinders at gaps formed between the outer curved surfaces of adjacent cylinders.

To combat this problem, crash barriers have been provided with one or more cables strung alongside the crash barrier between the barrier and the roadway, as shown for example in U.S. Pat. Nos. 5,011,326 and 5,403,112 to Carney III. The cables span the gaps between adjacent cylinders and assist in redirecting the errant vehicle back onto the roadway.

Another solution to avoid pocketing of the vehicle in the array of cylinders is shown in U.S. Pat. No. 3,845,936 to Boedecker. In particular, a series of sheet-like fish scales are positioned between the cylinders and the roadway. The fish scales are attached to selected ones of the cylinders. The fish scales are relatively expensive structurally rigid plates that are attached to the cylinders in a relatively complex manner.

SUMMARY

By way of introduction, various preferred embodiments of the crash cushion described below include a cylinder, preferably resilient and self-restoring, having a substantially vertical longitudinal axis and an outer surface comprising a curved portion adapted to be exposed to a roadway. A deflector skin has a curved contour shaped to mate with the curved portion of the outer surface of the cylinder. The deflector skin is mounted to the cylinder on the outer surface over at least a portion of the curved portion of the outer surface.

In one aspect, one preferred embodiment of crash cushion system includes an array of cylinders having a side and at least one deflector skin which is mounted to at least one of the cylinders on the outer surface thereof over at least a portion of the curved portion that defines part of the side of the array. In a preferred embodiment a plurality of deflector skins are each mounted to a corresponding one of the cylinders.

In another aspect, one preferred embodiment of the crash cushion system includes a plurality of cylinders, at least some of which define a side of the array. Each of the cylinders defining the side of the array has an outermost vertical tangent, and the combination of such tangents preferably defines a vertical plane. At least one, and preferably a plurality of deflector skins, each including a leading edge and a trailing edge, is mounted to a corresponding one of the cylinders forwardly of the tangent. In one preferred embodiment, the deflector skins are substantially flat and are oriented in a non-parallel relationship with the vertical plane. Preferably, only the leading edge of the deflector skins is mounted to the cylinder, with the trailing edge being a free edge.

In one preferred embodiment, the crash cushion assembly includes a plurality of first and second deflector skins mounted to corresponding cylinders. Preferably, the second, outer deflector skin has a greater thickness than the first, inner deflector skin.

In another aspect, one preferred embodiment of a method for attenuating the impact of a vehicle striking a crash cushion system includes impacting a side of a crash cushion and thereby impacting at least one of the deflector skins. In another preferred embodiment, the method includes impacting a front of the crash cushion and thereby compressing at least some of the cylinders, but without substantially deforming one or more of the deflector skins. In one preferred embodiment, the frontal impact includes deforming at least one of the first curved deflector skins without substantially deforming the second deflector skins secured along only the leading edges thereof.

In another aspect, a method of assembling a crash cushion system includes arranging a plurality of cylinders in an array, positioning cylinders having a deflector skin along a side of the array and orienting the cylinders with deflector skins with the skins facing outwardly from the side of the array.

The various preferred embodiments provide significant advantages over other crash cushions. In particular, the cylinders can each be individually configured with one or more deflector skins. Accordingly, the cylinders can be easily arranged or configured in different arrays without expensive customization. Moreover, if one or more cylinders or deflector skins are damaged, they can be easily replaced.

In addition, in one preferred embodiment, the deflector skin having a leading edge mounted in front of the tangent and a free edge extending away therefrom can be angled out of the plane of the side of the array so as to provide resistance to penetration, scoring and/or gouging of the cylinders during the initial impact of a vehicle at an angle to the side of the crash cushion. Moreover, since the deflector skin is preferably secured along only one edge, it is not substantially deformed during a frontal, or axial, impact and does not interfere with the operation of the energy absorbing cylinders.

The inner, curved deflector skins also provide the advantage of providing a lower coefficient of friction than the underlying cylinder, such that the vehicle tends to slide along the deflector skin. Moreover, the deflector skin acts as armor plating, and is not as easily gouged as the underlying cylinder, so as to further avoid snagging of the impacting vehicle. Preferably, the inner deflector skin is thinner than the outer deflector skin, and thereby can bend and deform with the cylinder during a frontal impact. Moreover, the positioning of the deflector skins provides discrete protection for the cylinders in the area vulnerable to a lateral impact, yet does not interfere with the overall operation of the system.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
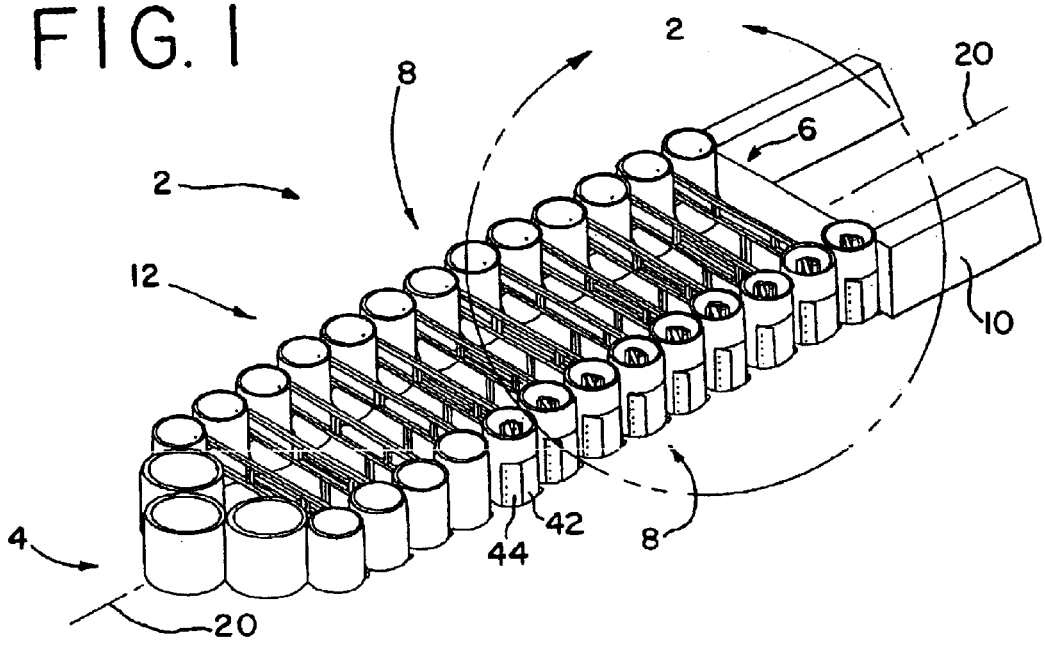
FIG. 1 is a perspective view of a crash cushion system.
Figure 2:
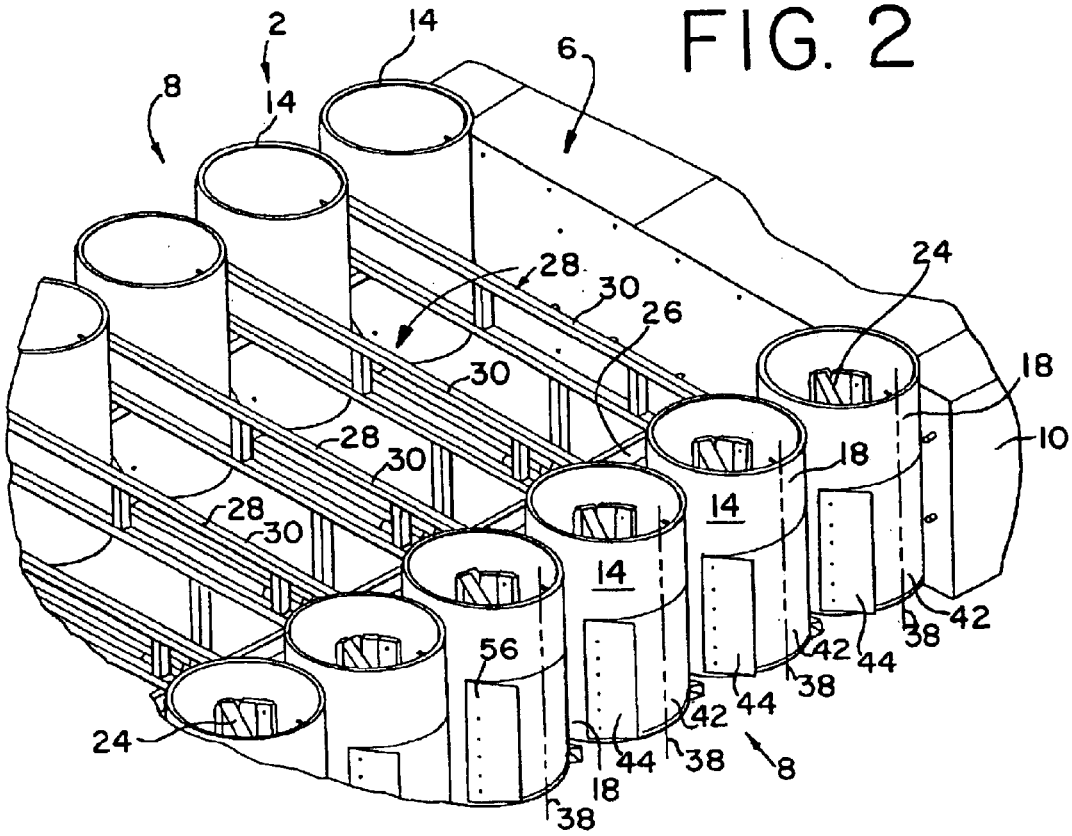
FIG. 2 is an enlarged partial perspective view of the crash cushion system shown in FIG. 1.

Referring to FIGS. 1-4, one preferred embodiment of a crash cushion 2, otherwise referred to as a vehicle impact attenuator, is shown in an initial position, prior to impact. The crash cushion 2 has a front 4 facing the flow of oncoming traffic and a rear 6 positioned adjacent to a backup 10, which can be any hazard alongside a roadway. Typically, the backup 10 is a rigid object, such as a bridge abutment, tollbooth, wall, guardrail, moving vehicle such as a truck, or other obstruction positioned in or along the roadway. The crash cushion 2 also has a pair of opposite sides 8, at least one of which is exposed to the roadway and the flow of traffic. In one embodiment, shown in FIGS. 1-4, both of the sides 8 are exposed to the traffic flow, for example when the crash cushion 2 is positioned in front of a tollbooth. In other embodiments, the crash cushion 2 may have only one side exposed to the traffic, with the other side facing away from the traveled lanes of the roadway, and which may be positioned along a backup, or other rigid object. Of course, both the rear and one side, or one side only, may be positioned adjacent a backup to provide protection thereagainst.

In another embodiment (not shown), the crash cushion is mounted to the rear of a vehicle, such as a truck. In such an embodiment, it should be understood that the front of the crash cushion is the portion facing the flow of traffic farthest from the rear of the vehicle to which it is mounted, with the rear of the crash cushion being closest to the rear of the vehicle.

Figure 13:
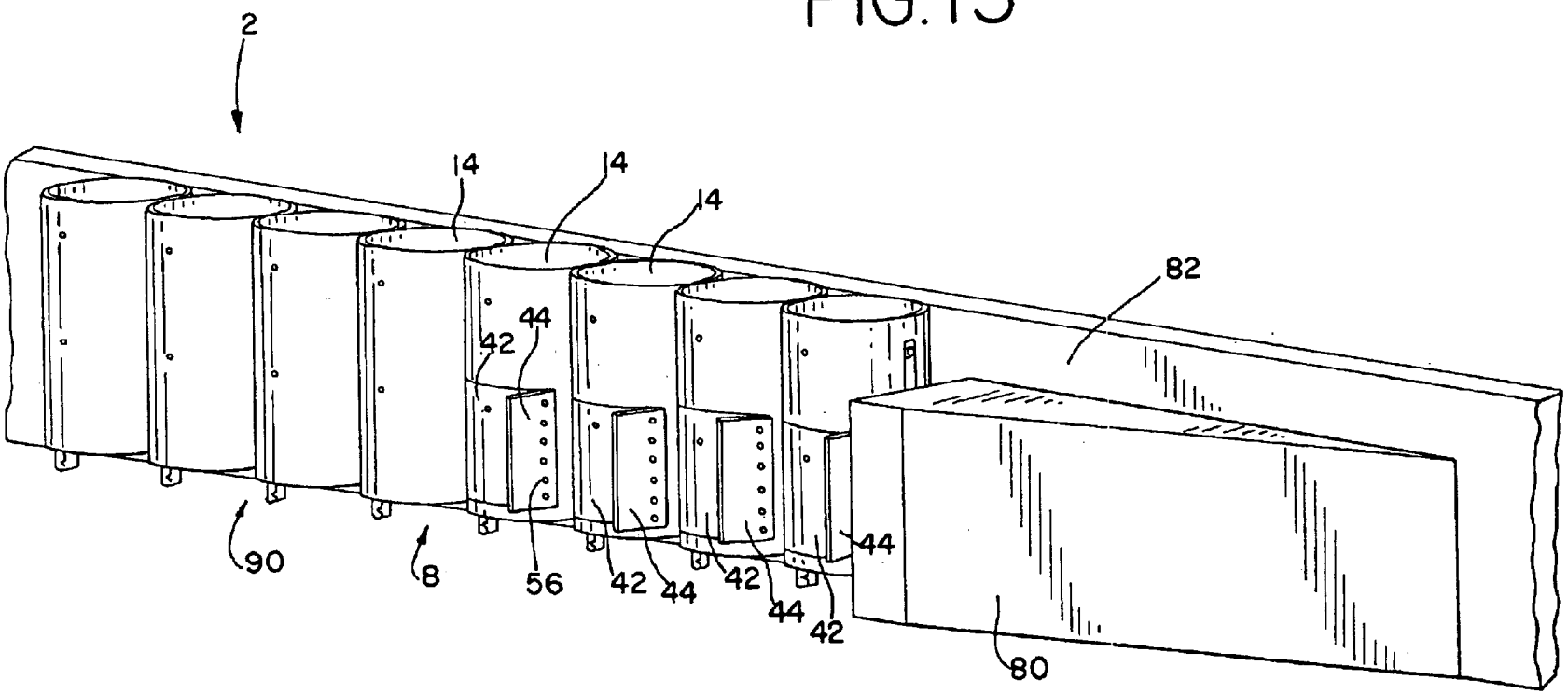
FIG. 13 is a perspective view of an alternative embodiment of a crash cushion system.

In yet another embodiment, shown in FIG. 13, the crash cushion 2 is positioned behind a first rigid object 80, shown as a tapered transition barrier, and along side a second rigid object 82, shown as a wall, such that the front of the crash cushion is positioned closest the first rigid object 80. The first and second rigid objects 80, 82 can be made separate or integral, for example by concrete casting. The crash cushion includes an array 90 of cylinders 14 that are secured to each other and to the wall 82. This crash cushion configuration, without deflector skins, is available from Energy Absorption Systems, Inc., having offices in Chicago, Ill. and which is the assignee of the present application, as the CushionWall II™ system.

Referring to FIGS. 1-4, the crash cushion 2 preferably includes an array 12 of tubes, preferably formed as cylinders 14. It should be understood that the term "cylinder" as used herein means any upright member, and is not limited to a member having a circular cross-section, but may be configured with an elliptical cross-section, or other symmetrical or non-symmetrical cross-sections, including for example rectangular and triangular cross-sections. Preferably, but without limitation, at least a portion of the outer surface of the cylinder (which outer surface preferably may be linear or curvilinear or some combination thereof) is defined by a continuum of points maintained in the same orientation, but not necessarily at a fixed distance, relative to a vertically oriented axis as the continuum is moved about the axis. For example, in one preferred embodiment, the continuum of points is formed as a vertical line, which is moved parallel to the axis to form the cylinder.

Referring to FIGS. 5-8, each cylinder 14 is preferably oriented with a longitudinal axis 16 positioned substantially vertically. It should be understood that the term "longitudinal," as used herein, means of or relating to length or the lengthwise direction, for example from the front 4 to the rear 6 of the crash cushion 2, or from the bottom to the top of the cylinder. The term "laterally," as used herein means situated on, directed toward or running from side to side of the crash cushion, or directed at the side of the crash cushion along a trajectory non-parallel thereto.

The cylinders 14 each have an outer circumferential surface 18 and are formed by a wall 22 having thickness. Preferably, the wall thickness is less than about 3 inches, more preferably between about 0.5 and 2.0 inches, and most preferably between about 0.75 inches and about 1.75 inches. In one preferred embodiment, the cylinders 14 each have an outer diameter of about 24 inches and a length or height of about 40 inches. Of course, it should be understood that other shapes and sizes would also work as explained above.

For example, the cylinders can be configured with alternative cross-sections, such as ellipses, ovals and the like, each of which has an outer curved surface presented to the traffic flow, with the outer curved surface having an outermost tangent. In one alternative embodiment, an upright member, for example a wall, is configured with a plurality of outer convex surfaces that face outwardly toward the flow of traffic.

The cylinders are preferably made of a resilient, polymeric material, such as high-density polyethylene (HDPE), including for example high molecular weight (HMW HDPE) high-density polyethyelene, such that the cylinders are self-restoring after impact. One suitable material is HDPE 3408. In other preferred embodiment, the cylinders are made of elastomeric materials, such as rubber, or combinations of polymeric and elastomeric materials. As used herein, the term "self-restoring" means that the cylinders return substantially (though not in all cases completely) to their original condition after at least some impacts. Therefore, to be self-restoring, the cylinder does not have to return to exactly its original condition. The term "resilient," as used herein, means capable of withstanding shock without permanent deformation or rupture. Of course, it should be understood that the cylinders can be made of other materials, and can be solid rather than hollow, or can be filled with various materials, such as water or sand. The cylinders 14 each deform resiliently in response to compressive loads extending along a diameter of the cylinder, thereby providing forces that tend to slow an impacting vehicle. The resiliency of the individual cylinders restores the cylinders substantially to the original configuration after the impact, and preferably after many impacts.

In one preferred embodiment, shown in FIGS. 1-4, the array 12 defines a longitudinal direction 20 extending forwardly from the backup 10. In one preferred embodiment, the front 4 is positioned farther from the backup 10 than the rear 6. Again, in other preferred embodiments, the front 4 and/or one side 8 of the array can be secured to or positioned adjacent a backup. The cylinders 14 are preferably secured together and to the backup 10, whether directly or by way of intervening frame members 28. The array preferably includes a plurality of cylinders 14, preferably including a plurality of rows of the cylinders, with each row having at least one cylinder. The term "plurality" as used herein means more than one, or two or more. In this example, each of the rows includes two cylinders 14, each disposed on a respective side of the centerline of the array, which centerline is aligned in the longitudinal direction 20. Preferably, each of these cylinders 14 includes a compression element 24 that is designed to resist compression of the respective cylinder 14 along a respective compression axis, while allowing elongation of the cylinder 14 along the same axis and collapse of the cylinder parallel to the longitudinal direction 20 of the array. The term "compression element," as used herein, is intended to encompass a wide variety of structures that effectively resist compressive loads along a compression axis while allowing substantial compression in at least some other direction. One preferred embodiment of a compression element is described and shown in U.S. patent application Ser. No. 09/799,905, filed Mar. 5, 2001, entitled "Energy-Absorbing Assembly For Roadside Impact Attenuator," and assigned to the assignee of the present invention, the entire disclosure of which is hereby incorporated herein by reference.

In the preferred embodiment shown in FIGS. 1-4 and 12, an elongated structure takes the form of a rail 26 that is secured in place in alignment with the longitudinal direction 20, for example, by bolting the rail to a support surface. This rail 26 may take the form of the rail described in U.S. Pat. No. 5,733,062, assigned to the assignee of the present invention and hereby incorporated by reference. The crash cushion also includes a plurality of frame members 28. In this embodiment, each of the frame members 28 includes one or more transverse elements 30 that are secured to adjacent ones of the cylinders 14 in each row and is configured with guides 29, shown in FIG. 12, which slide along the length of the rail 26 in an axial impact. The guides 29 are captured under a top portion of the rail 26 and restrain lateral movement of the frame member 28 while simultaneously permitting axial movement in the longitudinal direction 20.

In an axial impact, the frame members 28 slide along the rail 26, and the cylinders 14 are flattened along the longitudinal direction. Deformation of the cylinders 14 absorbs kinetic energy and decelerates the impacting vehicle.

In a lateral impact, the compression elements 24 transfer compressive loads to the transverse elements 30, which in turn transfer the compressive loads to the rail 26 by way of the guides 29. This provides substantial lateral stiffness to the crash cushion such that the crash cushion redirects an impacting vehicle that strikes the crash cushion laterally. Because the frame members 28, guides 29 and the elongated structure, including the rail 26, are positioned inboard of the vertically oriented outermost tangents of the cylinders 14, a vehicle traveling down the side 8 of the crash cushion 2 cannot engage the guides or the elongated structure in a fashion likely to cause snagging of the impacting vehicle.

Figure 10:
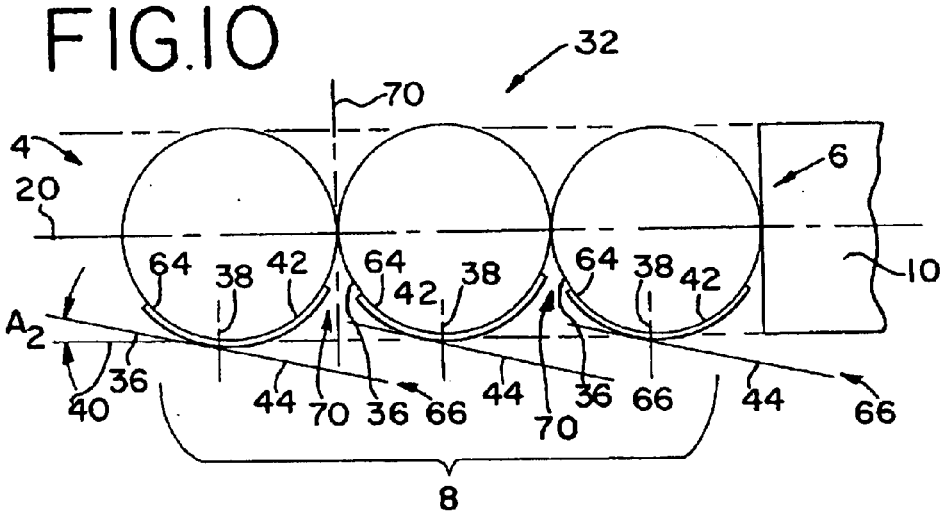
FIG. 10 is a top view of an alternative embodiment of a crash cushion system.
Figure 11:
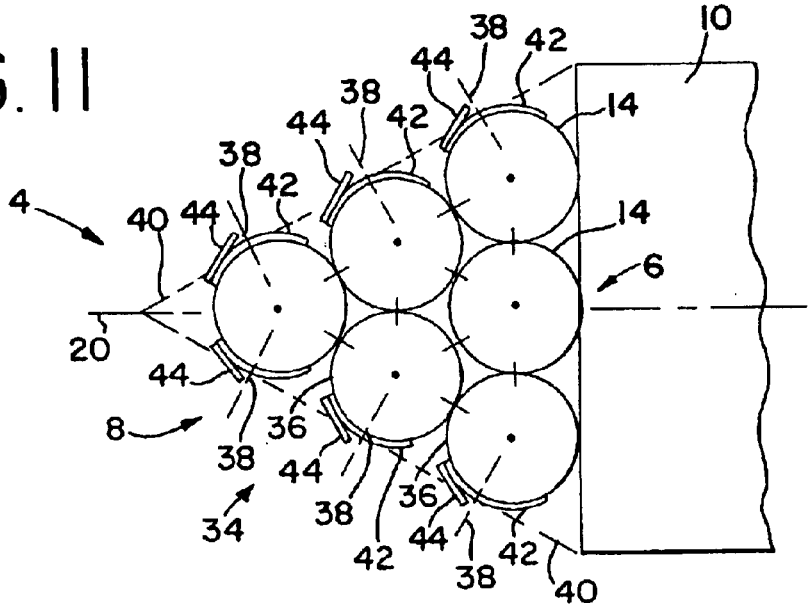
FIG. 11 is a top view of an alternative embodiment of a crash cushion system.
Figure 12:
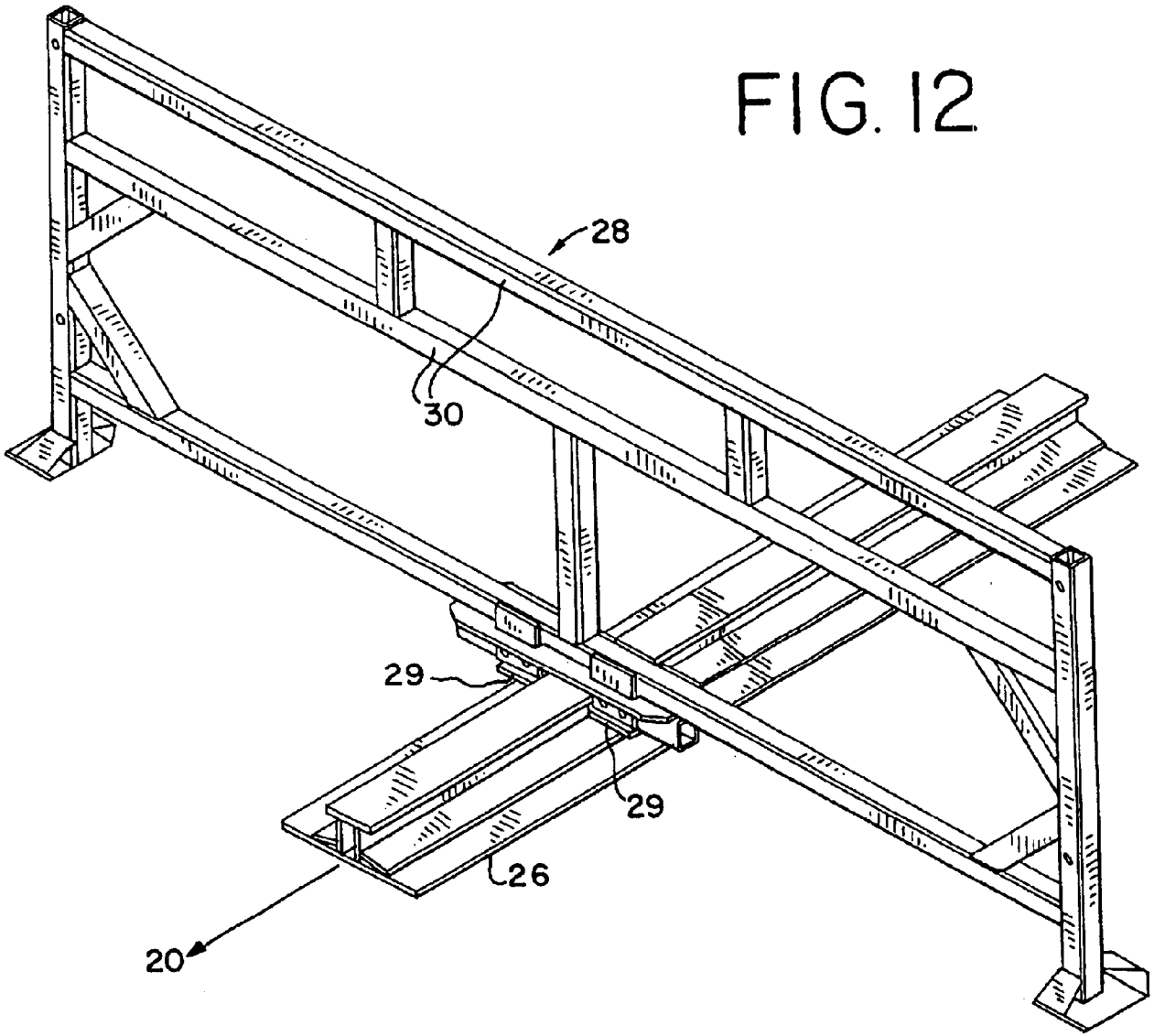
FIG. 12 is a perspective view of a transverse frame structure slidably engaging a rail and forming part of the crash cushion system shown in FIG. 1.

It should be understood that pluralities of the cylinders 14 can be configured in many different arrays, and that the crash cushion embodiment shown in FIGS. 1-4, with its rail, frame members including the transverse elements and compression elements, is meant to be exemplary rather than limiting. For example, as shown in FIGS. 10 and 11, a plurality of cylinders 14 can be arranged in various arrays 32, 34, with the cylinders being mounted directly to one another, or to a frame structure. The array can be symmetrical; or asymmetrical, and the cylinders can be configured with or without compression elements. The array 34, 90 can include, for example and without limitation, a single column of cylinders 14, as shown in FIGS. 10 and 13, or can be configured with multiple columns of equal numbers of cylinders, or in a triangular configuration, as shown in FIG. 11, or in any other arrangement having at least one impact side 8 that is exposed to traffic.

Figure 3:
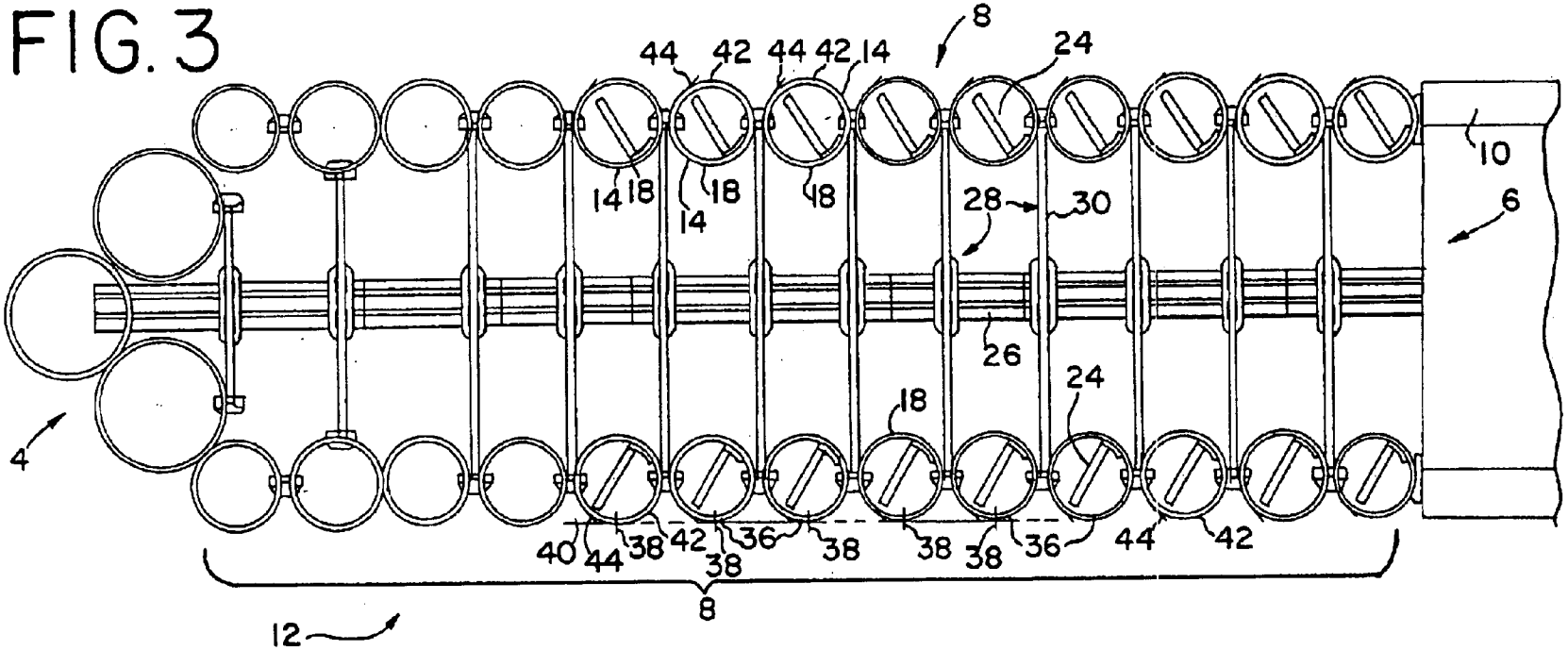
FIG. 3 is a top view of the crash cushion system shown in FIG. 1.
Figure 4:
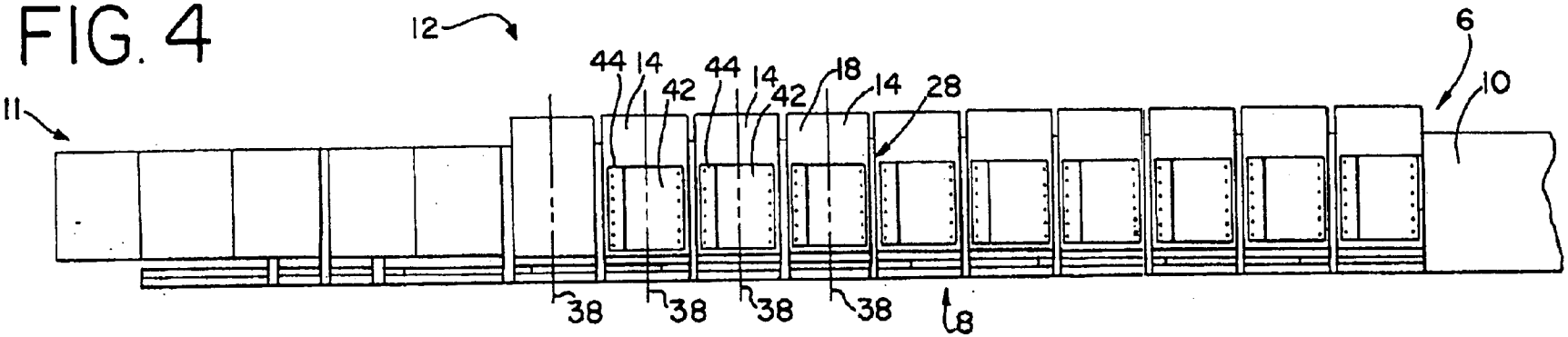
FIG. 4 is a side view of the crash cushion system shown in FIG. 1.
Figure 5:
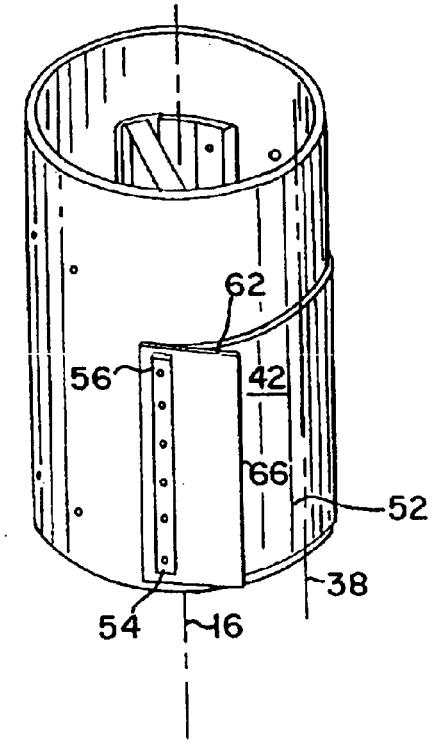
FIG. 5 is a perspective view of a cylinder with a first and second deflector skin mounted thereto.
Figure 6:
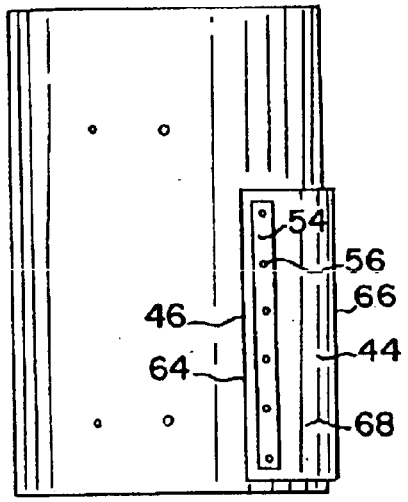
FIG. 6 is a front view of the cylinder shown in FIG. 5.
Figure 7:
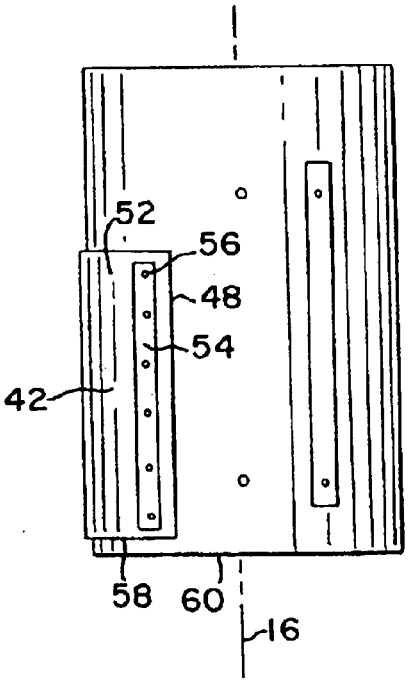
FIG. 7 is a rear view of the cylinder shown in FIG. 5 with the cylinder rotated approximately, 180 degrees relative to the view of FIG. 6.
Figure 8:
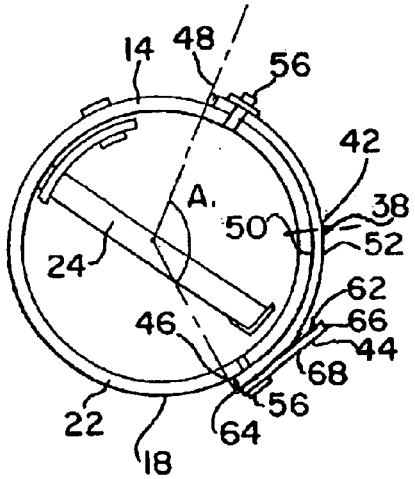
FIG. 8 is a top view of the cylinder shown in FIG. 5.

Referring to FIGS. 3, 10 and 11, the array 12, 32, 34 has a side 8 defined by the outermost half, or outer semi-circular portion 36, of the circumferential surface 18 of the outermost cylinders in the array. When the outermost cylinders are arranged linearly, in a column, as shown in each of FIGS. 3, 10 and 11, approximately 180° of the outer circumferential surface 18 relative to the center of each cylinder forms and defines the side 8 of the array. It should be understood, however, that if the cylinders positioned along and defining the side of the array are not arranged linearly, a greater or lesser amount of the circumferential surface of each cylinder will form and define the side. In the preferred embodiment, where an outermost column of cylinders 14 is arranged linearly to define the side 8 of the array, each cylinder 14 has a vertically oriented outermost tangent 38, with the combination of the tangents 38 defining a substantially vertical plane 40.

Referring to FIGS. 1-4, in one preferred embodiment, each of a selected number of the plurality of cylinders 14 defining the side 8 of the array is configured with a first and second deflector skin 42, 44. Likewise, as shown in FIGS. 10 and 11, the cylinders 14 defining at least one side 8 of the array are each configured with a first and second deflector skin 42, 44. It should be understood that the system could include only a single cylinder configured with one or both of the first and second deflector skins, but that preferably a plurality of cylinders forming the side of the array are so configured. Of course, it should be understood that not all of the cylinders forming the side need be so configured.

Referring to one preferred embodiment of the cylinder shown in FIGS. 5-8, the first deflector skin 42 has a curved contour that is shaped to mate with the outer surface of a corresponding one of the cylinders 14 to which it is secured. In this way, the deflector skin 42 is preferably formed as an arc shaped panel, or plate. Preferably, the deflector skin 42 is made of a thin sheet of metal, such as an 18 gauge CR (cold-rolled) sheet, which has a lower coefficient of friction relative to the vehicle or wheel than does the cylinder 14. Of course, it should be understood that the deflector skin can be made of other metals, including other steels, aluminum or titanium, or various plastics or polymeric materials and/or combinations thereof. Moreover, the deflector skin can be made as a laminate structure, with various substrates being made of different materials. In one preferred embodiment, the deflector skin 42 has a width of about 23⅞ inches and a height of about 24 inches.

Preferably, the first deflector skin 42 is centered on the cylinder 14 about the tangent 38 of the cylinder to which it is secured or mounted, with the first deflector skin extending equal amounts forwardly and rearwardly from the tangent. In other embodiments, the first deflector skin is not centered about the tangent, and may even be positioned entirely in front of or behind the tangent. In one preferred embodiment, the first deflector skin 42 has a leading edge 46 and a trailing edge 48, both of which are preferably secured to the cylinder 14. The deflector skin 42 has an inner surface 50 and an outer surface 52. In one preferred embodiment, the inner surface 50 is abutted against the outer surface 18 of the cylinder, and a washer bar 54 is positioned on the outer surface 52 of the deflector skin adjacent the trailing edge 48. In one preferred embodiment, where the deflector skin 44 is omitted, a second washer bar 54 is positioned on the outer surface 52 of the deflector skin 42 adjacent the leading edge 46. A plurality of mechanical fasteners 56, shown as two rows of six fasteners, are used to secure the deflector skin 42 and washer bars 54 to the cylinder. The fasteners may take the form of various known types, including for example and without limitation, various screws, nuts, bolts, and washers. In one preferred embodiment, the distance between the rows of fasteners is about 21 and 11/16 inches, forming an angle of about 104 degrees relative to the axis of the cylinder. One or more washer bars or washers can also be used inside the cylinder to secure the fasteners on the inner surface thereof. It should be understood that in alternative embodiments, the deflector skin 42 can be secured to the cylinder 14 with adhesives, with tabs or other snap-fit devices, with guides shaped to receive the ends thereof, by welding, or by other devices available and known to those of skill in the art. Preferably, openings on one of the leading or trailing edges of the deflector skin, or the mating openings formed in the cylinder, which receive the fasteners, are slotted to allow for tolerance build-ups and ease of assembly.

Preferably, the first deflector skin 42 is secured to a lower portion of the cylinder 14, with a bottom edge 58 of the skin being positioned adjacent to or slightly above the bottom edge 60 of the cylinder. Preferably, the deflector skin 42 covers only a discrete portion of the outer circumferential surface, and preferably at least a portion of the outer surface that is exposed to a lateral impact. In this way, the deflector skin 42 preferably does not extend around the entire periphery of the cylinder, such that the cylinder assembly can be made lighter and at lower costs. In one preferred embodiment, the first deflector skin 42 extends around the circumferential surface of the cylinder and forms an angle A1 between the leading and trailing edges 46, 48 relative to the center of the arc of the deflector skin or the axis 16 of the cylinder, which centers are preferably substantially coaxial. The angle A1 is preferable greater than about 60°, more preferably greater than about 90° and even more preferably greater than about 100°, although angles less than 60° would of course also work. In one alternative embodiment, the deflector skin can be secured around the entire circumference of the cylinder.

It should be understood that the terms "mounted," "secured," "attached," and variations thereof, mean that one member is connected to another member, whether directly or by way of another member, and regardless of whether other members may be interposed between the members being so mounted, secured or attached. Thus, for example, a first member directly attached to a second member is also attached to a third member by way of the second member being attached to the third member.

Referring again to FIGS. 5-8, a second deflector skin 44 has an inner surface 62 mounted to the outer surface 52 of the first deflector skin 42 and to the cylinder 14. Preferably, the second deflector skin 44 is substantially flat and has a leading edge 64 and a trailing edge 66. In other embodiments, the second deflector skin 44 can be provided with a curvature, preferably having an outer convex curved surface. Preferably, the leading edge 64 is secured to the outer surface 52 of the first deflector skin 42 with one row of the fasteners 56 and one washer bar 54 positioned on the outer surface of the second deflector skin 44 and located adjacent the leading edge 46 of the first deflector skin 42. It should be understood that the second deflector skin 44 can be used independently without the first deflector skin, for example and without limitation by mounting it directly to the cylinder. Conversely, the first deflector skin 42 can be used independently by itself, without the second deflector skin. Preferably, the trailing edge 66 of the second deflector skin 44 is not secured to either the first deflector skin 42 or the cylinder 14, and remains as a free edge that can flex in response to the impact of a vehicle. In one preferred embodiment, the trailing free edge 66 does not extend rearwardly beyond the tangent 38 of the corresponding cylinder to which it is attached, or substantially outboard of or beyond the vertical plane 40 defined by the tangents 38. Preferably, the second deflector skin 44 is non-parallel to and forms an angle A2 with the vertical plane 40, preferably with its outer surface 68 angled so as to redirect the impacting vehicle back into traffic. Preferably, the angle A2 is greater than 0°, and more preferably between about 5° and 75°, and even more preferably between about 30° and 60°, and most preferably about 52°.

Preferably, the second deflector skin 44 is relatively stiff and resilient and is capable of aiding in the redirection of an errant vehicle back on to the roadway. Preferably, the second deflector skin 44 is stiffer than the first deflector skin 42, and has a greater thickness than the first deflector skin 42, although it should be understood that the converse would also work, or alternatively that the deflector skins can be made of the same materials and have the same thicknesses. For example, in one preferred embodiment, the second deflector skin is made of 14 gauge HR (hot rolled) sheet. Of course, other materials, including other steels, and constructions such as a laminate, would also work as explained above with respect to the first deflector skin. Preferably, the material of the second deflector skin has a lower coefficient of friction relative to the vehicle or wheel than does the cylinder. In addition, the material of the first and second deflector skins preferably has a tensile yield strength of greater than about 4 ksi, more preferably greater than about 5 ksi, and even more preferably greater than about 20 ksi. In one preferred embodiment, the second deflector skin has a width of about 8 inches and a length of about 24 inches. Preferably, the second deflector skin 44 is vertically aligned with respect to the first deflector skin 42 in an overlapping relationship therewith, and with the leading edges thereof being preferably substantially flush. The dimensions and materials of the cylinder and deflector skins are meant to be exemplary rather than limiting, and larger and smaller cylinders and skins made out of a variety of materials would also work.

In one preferred embodiment, the trailing free edge 66 of the second deflector skin 44 does not extend rearwardly beyond the tangent 38 of the corresponding cylinder 14 to which the deflector skin 44 is attached, but does extend up to or outwardly from the vertical plane 40 defined by the tangents. In other preferred embodiments, the free edge 66 terminates inwardly of the vertical plane 40.

In one alternative preferred embodiment, shown in FIG. 10, the trailing free edge 66 of the second defector skin 44 extends rearwardly beyond a plane 70 formed tangentially to the cylinder 14 and oriented substantially perpendicular to the plane 40 formed by the tangents 38. Preferably, the trailing free edge 66 extends rearwardly of the leading edge 64 of the second deflector skin 44 secured to the next adjacent cylinder 14 positioned rearwardly thereof.

It should be understood that other deflector skins could be mounted on top of or between the aforedescribed first and second deflector skins without departing from the scope of the invention. Likewise, other components, surface treatments and the like can be applied to or mounted on the deflector skins.

In operation, the crash cushion 2 is designed to absorb the energy of a vehicle axially impacting a front 4 of the crash cushion and redirecting the vehicle back onto the roadway when impacting a side 8 of the cushion or array. For example, when a vehicle impacts the front 4 of the array, the cylinders 14 are flattened along the longitudinal direction 20. Depending on the configuration of the system, the cylinders may be guided by a rail, as explained above, or may be tethered or secured together by other fasteners and devices. Moreover, one or more compression elements can be designed to absorb the energy of the vehicle, if desired.

Figure 9:
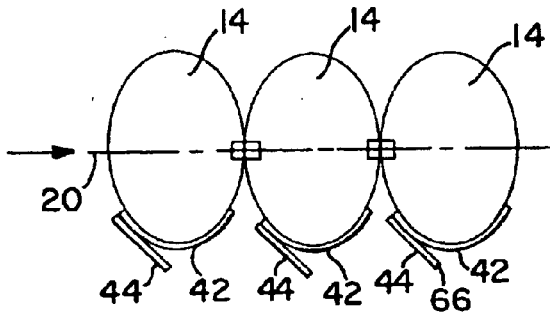
FIG. 9 is a top view of a plurality of cylinders in a compressed or deformed state.

During this sequence, as shown in FIG. 9, the first deflector skins 42, which preferably extend along only a portion of the sides of the outermost surface of the cylinders 14 defining the impact side of the array or cushion, also bend or deform with the cylinders 14 in the longitudinal direction. Preferably, the first deflector skins 42, which are relatively thin and resilient, are capable of being restored to substantially their original shape, whether by way of self-restoration or with the aid of the self-restoring cylinders to which they are attached. During the front, axial impact, the second deflector skin 44, which is preferably secured along only the leading edge 64, is not bent or otherwise deformed, but rather simply moves with the cylinder 14 and rotates as the cylinder is compressed as shown in FIG. 9. After the incident, the cylinders, including those with and without deflector skins, can be restored to substantially their original shape. Those cylinders that are not restorable can be replaced. Likewise, deflector skins that cannot be restored, or are otherwise damaged beyond use, can be easily replaced on the corresponding cylinder.

When a vehicle impacts the side 8 of the array, the deflector skins 42, 44 redirect the vehicle smoothly back onto the roadway. For example, when the angle of impact is relatively large relative to the vertical plane 40, the second deflector skin 44 redirects the wheel or other portion of the vehicle towards the rear 6 so as to avoid pocketing in the array of cylinders. When the angle is more shallow, the vehicle will glance off one or both of the first and second deflector skins 42, 44. The deflector skins 42, 44, with their relatively low coefficients of friction, allow the vehicle to slide along the deflector skins 42, 44 and also prevent the vehicle from gouging the cylinder 14 or otherwise becoming snagged thereon. Moreover, the deflector skins 42, 44 increase the stiffness of the cylinders in the lateral direction and thereby help prevent the vehicle from pocketing in the cylinders.

When a vehicle impacts the side of the crash cushion shown in FIG. 10, the free edge 66 of the impacted second deflector skin 44 flexes or bends inwardly towards the second deflector skin 44 on a next adjacent cylinder. Since the free edge 66 extends rearwardly of the leading edge 64 of the next adjacent deflector skin, the deflector skins in combination act as overlapping members to prevent the vehicle from pocketing in the gaps 70 formed between the cylinders.

By securing individual deflector skins 42, 44 to corresponding individual cylinders 14, various configurations of crash cushions can be configured and deployed easily and inexpensively due to the diminished amount of customization of the various components. In essence, the system is modular, permitting like components to be configured and reconfigured as needed.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A crash cushion system comprising:

an array of resilient, self-restoring cylinders each having a substantially vertical longitudinal axis and an outer surface comprising a convex shaped curved portion, wherein said array comprises a plurality of said cylinders, and wherein said array of cylinders has a front, a side and a rear, wherein said side is defined at least in part by said curved portions of at least some of said plurality of said cylinders, wherein said outer surface of corresponding ones of said cylinders each define a perimeter of said corresponding ones of said cylinders; and at least one deflector skin comprising an inner surface and an outer surface, wherein said inner surface has a concave shaped curved contour shaped to mate with and facing said convex shaped curved portion of said outer surface of at least one of said cylinders forming said side of said array, wherein said at least one deflector skin is mounted to said at least one of said cylinders on said outer surface thereof over at least a portion of said curved portion that defines part of said side of said array, and wherein said at least one deflector skin extends around only a portion of said perimeter of said at least one of said cylinders.

2. The invention of claim 1 wherein said at least one deflector skin comprises a plurality of deflector skins each comprising an inner surface and an outer surface and having a curved contour shaped to mate with said outer surface of a corresponding one of at least some of said cylinders forming said side of said array, wherein each of said plurality of said deflector skins is mounted on said outer surface of said corresponding one of said cylinders over at least a portion of said curved portion of said outer surface that defines part of said side of said array.

3. The invention of claim 2 wherein said deflector skins each extend around only a portion of said perimeter of said corresponding one of said cylinders.

4. The invention of claim 1 wherein said plurality of cylinders are made in part of an elastomeric material.

5. The invention of claim 1 wherein said inner surface of said at least one deflector skin contacts said outer surface of said at least one of said cylinders.

6. A crash cushion system comprising:

an array of resilient, self-restoring cylinders each having a substantially vertical longitudinal axis and an outer surface comprising a curved portion, wherein said array comprises a plurality of said cylinders, and wherein said array of cylinders has a front, a side and a rear, wherein said side is defined at least in part by said curved portions of at least some of said plurality of said cylinders; and a plurality of deflector skins each comprising an inner surface and an outer surface and having a curved contour shaped to mate with said outer surface of a corresponding one of at least some of said cylinders forming said side of said array, wherein each of said plurality of said deflector skins is mounted on said outer surface of said corresponding one of said cylinders over at least a portion of said curved portion of said outer surface that defines part of said side of said array, and wherein said plurality of deflector skins comprises a plurality of first deflector skins, and further comprising a plurality of second deflector skins each mounted on said outer surface of a corresponding one of said plurality of said first deflector skins.

7. The invention of claim 6 wherein said each of said plurality of second deflector skins is substantially flat and extends tangentially from said outer surface of said corresponding one of said plurality of said first deflector skins.

8. The invention of claim 7 wherein each of said corresponding ones of said cylinders comprises an outermost vertically oriented tangent, and wherein said leading edge of each of said plurality of said second deflector skins is mounted on said first deflector skin forwardly of said tangent on said corresponding one of said cylinders.

9. The invention of claim 6 wherein said plurality of said second deflector skins each have a leading edge and a trailing edge, wherein said leading edge of each of said plurality of said second deflector skins is secured to said corresponding one of said plurality of said first deflector skins and wherein said trailing edge is a free edge.

10. The invention of claim 9 wherein said each of said plurality of said first deflector skins has a leading edge and a trailing edge, wherein said leading and trailing edges of each of said plurality of said first deflector skins are secured to said corresponding one of said cylinders.

11. The invention of claim 6 wherein each of said plurality of said first deflector skins has a first thickness and wherein each of said plurality of said second deflector skins has a second thickness, wherein said second thickness of each of said plurality of said second deflector skins is greater than said thickness of said corresponding one of said plurality of said first deflector skins.

12. The invention of claim 6 wherein said plurality of said first deflector skins and said plurality of said second deflector skins are made at least in part of metal, and wherein said plurality of cylinders are made at least in part of a polymeric material.

13. A crash cushion system comprising:

an array of resilient, self-restoring cylinders each having a substantially vertical longitudinal axis and an outer surface comprising a curved portion, wherein said array comprises a plurality of said cylinders, and wherein said array of cylinders has a front, a side and a rear, wherein said side is defined at least in part by said curved portions of at least some of said plurality of said cylinders, wherein each of said plurality of said cylinders defining said side comprises an outermost vertically oriented tangent; and a plurality of deflector skins each mounted on a corresponding one of at least some of said cylinders forming said side of said array, wherein each of said plurality of said deflector skins comprises a leading edge and a trailing edge, wherein said leading edge of each of said plurality of said deflector skins is secured to said corresponding one of said cylinders forwardly of said tangent on said corresponding one of said cylinders, and wherein said tangents of said corresponding ones of said cylinders in combination define a substantially vertical plane and wherein each of said plurality of said deflector skins is substantially flat and is oriented in a non-parallel relationship with said vertical plane.

14. The invention of claim 13 wherein said plurality of said deflector skins comprises a plurality of second deflector skins, and further comprising a plurality of first deflector skins disposed between said corresponding ones of said cylinders and said plurality of said second deflector skins secured thereto.

15. The invention of claim 14 wherein each of said plurality of said first deflector skins has a curved contour shaped to mate with said curved portion of said outer surface of said corresponding one of said cylinders.

16. The invention of claim 14 wherein each of said plurality of said first deflector skins has a first thickness and wherein each of said plurality of said second deflector skins has a second thickness, wherein said second thickness of each of said second deflector skins is greater than said first thickness of a corresponding one of said first deflector skins.

17. The invention of claim 14 wherein each of said plurality of said first and second deflector skins is made at least in part of metal, and wherein each of said plurality of said cylinders is made at least in part of a polymeric material.

18. The invention of claim 14 wherein said outer surface of said corresponding ones of said cylinders each define a perimeter of said corresponding ones of said cylinders, wherein said first deflector skins each extend around only a portion of said perimeter of said corresponding one of said cylinders.

19. A crash cushion system comprising:

an array of resilient, self-restoring cylinders each having a substantially vertical longitudinal axis and an outer surface comprising a curved portion, wherein said array comprises a plurality of said cylinders, and wherein said array of cylinders has a front, a side and a rear, wherein said side is defined at least in part by said curved portions of at least some of said plurality of said cylinders, wherein each of said plurality of said cylinders defining said side comprises an outermost vertically oriented tangent; and a plurality of deflector skins each mounted on a corresponding one of at least some of said cylinders forming said side of said array, wherein each of said plurality of said deflector skins comprises a leading edge and a trailing edge, wherein said leading edge of each of said plurality of said deflector skins is secured to said corresponding one of said cylinders forwardly of said tangent on said corresponding one of said cylinders, and wherein said trailing edge of each of said plurality of said deflector skins is a free edge, and wherein said free edge of a first one of said plurality of deflector skins extends rearwardly beyond said leading edge of a next adjacent second one of said plurality of said deflector skins positioned rearwardly of said first deflector skin.

20. A crash cushion system comprising:

an array of resilient, self-restoring cylinders each having a substantially vertical longitudinal axis and an outer surface comprising a convex shaped curved portion, wherein said array comprises a plurality of said cylinders, and wherein said array of cylinders has a front, a side and a rear, wherein said side is defined at least in part by said curved portions of at least some of said plurality of said cylinders; and at least one deflector skin made at least in part of metal and comprising an inner surface and an outer surface, wherein said inner surface has a concave shaped curved contour shaped to mate with and facing said convex shaped curved portion of said outer surface of at least one of said cylinders forming said side of said array, wherein said at least one deflector skin is mounted to said at least one of said cylinders on said outer surface thereof over at least a portion of said curved portion that defines part of said side of said array.

* * * * *